US005335598A

United States Patent [19]

Lewis et al.

[11] Patent Number: 5,335,598

[45] Date of Patent: Aug. 9, 1994

[54] TIMING AND FIRING CIRCUITRY

[75] Inventors: Donald J. Lewis, Scottsdale; Larry C. LaClair, Mayer, both of Ariz.

[73] Assignee: Universal Propulsion Company, Inc., Phoenix, Ariz.

[21] Appl. No.: 59,450

[22] Filed: May 7, 1993

[51] Int. Cl.[5] ..... F42C 11/06

[52] U.S. Cl. ..... 102/218; 361/251

[58] Field of Search ..... 102/206, 218; 361/247, 361/251

[56] References Cited

U.S. PATENT DOCUMENTS

| | | | |
|---|---|---|---|
| 3,329,092 | 7/1967 | Bassie | 102/206 |
| 3,930,449 | 1/1976 | Buchele | 102/206 |
| 4,022,131 | 5/1977 | Redding | 361/251 |
| 4,632,031 | 12/1986 | Jarrott et al. | 102/206 |
| 5,031,537 | 7/1991 | Taylor | 102/218 |

*Primary Examiner*—Ian J. Lobo

*Attorney, Agent, or Firm*—Ellsworth R. Roston; Charles H. Schwartz

[57] ABSTRACT

First and second ganged switches having first and second operative relationships are normally operative in the first relationship and are actuated by an external mechanism to the second relationship. In the first relationship, the first switch shunts and short circuits a pyrotechnic device and the second switch shunts and short circuits an energy storage member such as a capacitor. In the second operative relationship of the second switch, a battery charges the capacitor and also introduces a starting signal to an electronic timing circuit to institute a timing sequencer by the circuit for a pre-selected period that is selected via a series of inputs to the electronic timer. When the pre-selected time period has been timed out, the timing circuit introduces a signal to a solid state electronic switch which is normally in a non-conductive state to prevent actuation. The signal from the timing circuit causes the electronic switch to provide a low impedance. In the second operative relationship of the first and second switches, the capacitor discharges through a circuit including the second switch, the electronic switch, the capacitor and the pyrotechnic device. This discharge fires the pyrotechnic device.

22 Claims, 1 Drawing Sheet

TIMING AND FIRING CIRCUITRY

This invention relates to an electronic timer for a delay ordinance system. More particularly, the invention relates to an electronic timer which provides a pre-selected delay, variable on a pre-determined basis through a wide range of time, in actuating an ordinance system.

BACKGROUND OF THE INVENTION

Ordnance systems generally have three (3) separate units: (1) an input mechanism for initiating a timing operation representing a pre-selected delay, (2) a timing system for providing the pre-selected delay and (3) an output mechanism operated by the timing mechanism after the pre-selected delay. The input mechanism may take any one (1) of several different forms, all known in the prior art. For example, the input unit may provide (a) a gas input or a detonation input, (b) a mechanized input such as a lanyard, (c) an electrical input such as an electrical current, (d) an input based upon the attainment of a particular temperature or (e) an input based upon a particular pressure.

The timing systems in the prior art have generally been pyrotechnic. For example, a material has been combusted for a variable period of time dependent upon the characteristics of the combustible material. Such timing systems have had certain inherent disadvantages. For example, the timing has not been very accurate. Furthermore, the time delay provided by combustible materials has not been very long. The timing unit has also been disadvantageous because it has sometimes deteriorated with time and because it has sometimes provided an output at inappropriate times to actuate the output unit. These problems have occurred because the timing unit has been chemical. Such problems have been known to exist in the timing systems of the prior art for a relatively long period of time without any real ability to minimize the problems specified in this paragraph.

The output unit operated by the timing unit may have a number of different forms, all known in the prior art. For example, the output unit may constitute a cutter for a reefing line or may provide heat from a thermal battery. Generally, the input and output mechanisms have been more advanced in the prior art than the timing unit.

SUMMARY OF THE INVENTION

This invention provides a timing unit which overcomes the disadvantages discussed in the previous paragraphs. The timing unit provides an accurate delay of a pre-selected period where such period is pre-selected through a wide range of values such as between a few seconds and twenty four (24) hours. The timing unit is foolproof. In other words, the timing cannot be initiated by the timing unit until after the input unit has actuated the timing unit. Even when the timing unit is actuated by the input unit, the timing unit cannot operate to provide the pre-selected time delay until the timing unit has been primed as by the manual operation of a master switch. The timing unit does not deteriorate in its operation even when stored for long period of time.

In one embodiment, first and second ganged switches having first and second operative relationships are normally operative in the first relationship and are actuated by an external mechanism to the second relationship. In the first relationship, the first switch shunts and short circuits a pyrotechnic device and the second switch shunts and short circuits an energy storage member such as a capacitor.

In the second operative relationship of the second switch, a battery charges the capacitor and also introduces a trigger signal to an electronic timing circuit to institute timing by the circuit of a pre-selected period. When the pre-selected signal has been timed, the timing circuit introduces a signal to an electronic switch which is normally in a non-conductive state to provide a high impedance. The signal from the timing circuit causes the electronic switch to provide a low impedance.

In the second operative relationship of the first and second switches, the capacitor discharges through a circuit including the second switch, the electronic switch, the capacitor and the pyrotechnic device. This discharge fires the pyrotechnic device.

BRIEF DESCRIPTION OF THE DRAWING

The single FIGURE is a circuit diagram, partially in block form, of one embodiment of a timing and firing system for a delay ordinance system.

DESCRIPTION OF THE PREFERRED EMBODIMENT

Figure 1:
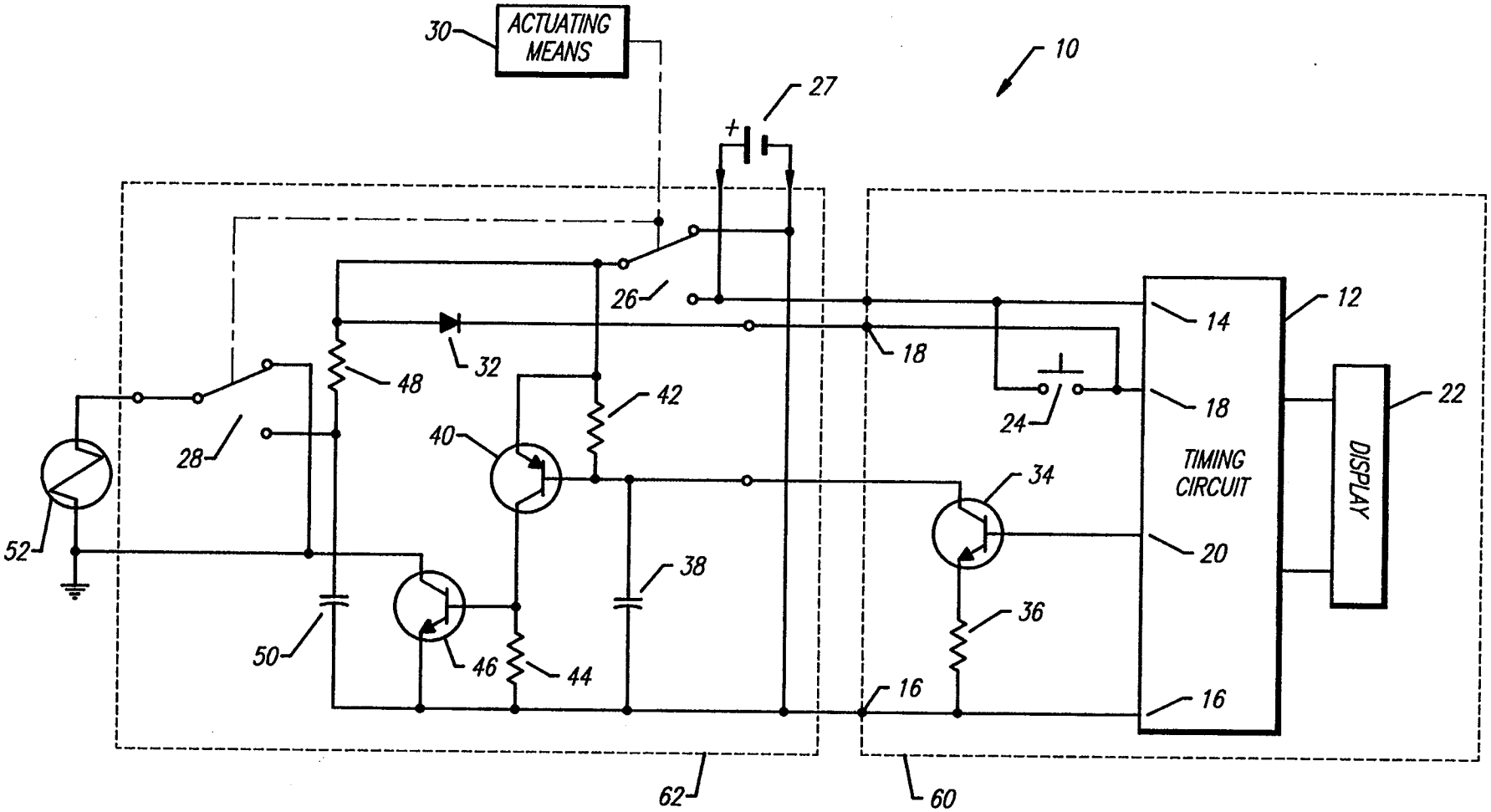

One embodiment of a timing and firing system for a delay ordinance system is generally indicated at 10 in the single FIGURE. The timing system 10 includes a timing circuit indicated in block form at 12. The timing circuit 12 may be formed in a conventional manner. Any different number of timing circuits may be used as the circuit 12. For example, the circuit 12 may constitute a watch circuit provided by the Timex Corporation.

The timing circuit 12 has several different terminals. These include a terminal 14 for receiving a position energizing voltage, a terminal 16 for providing a negative voltage, a terminal 18 for providing a start signal and a terminal 20 for providing an output signal. A display 22 provides a visual indication of the time delay pre-selected to be provided by the timing circuit 12.

A manually operated switch 24 has one stationary terminal connected to the start terminal 18 of the timing circuit 12. A second stationary terminal of the switch 24 has a common connection with one stationary terminal of a single-pole double-throw switch 26 and the positive terminal of a battery 27. The movable arm of the switch 26 is ganged to the movable arm of a switch 28. The movable arms of the switches 26 and 28 are normally in the position shown in the single FIGURE. The movable arms of the switches 26 and 28 are operatively coupled to actuating means shown at 30 in block form in the single FIGURE. The actuating means may provide an input to the system 10 to initiate the operation of the system 10.

The actuating means 30 may have a number of different forms, all known in the prior art. For example, the actuating means 30 may constitute (a) a gas input or a detonation unit, (b) a mechanized input such as a lanyard, (c) an electrical input such as an electrical current, (d) an input based upon the attainment of a particular temperature or (e) an input based upon a particular pressure. All of these inputs may be converted by means well known in the art to mechanical motions of the movable arms of the switches 24 and 26.

The upper and lower stationary contacts of the switch 26 are respectively common with the positive and negative terminals of a power supply such as a battery 27. The negative terminal of the battery 27 is also connected to the negative terminal 16 in the timing circuit 12. The lower stationary contact of the switch 26 is connected to the positive terminal 14 in the timing circuit 12 and to one of the stationary contacts in the switch 24. The movable arm of the switch 26 is common with the anode of a diode 32 having its cathode connected to the start terminal 18 in the timing circuit 12.

The output signal on the terminal 20 in the timing circuit 12 is introduced to the base of an npn-type transistor 34. The source of the transistor 34 may be common with one terminal of a resistor 36 having a relatively low value such as approximately two hundred ohms (200). A connection is made from the second terminal of the resistor 36 to the negative terminal 16 in the timing circuit 12.

A connection is made from the collector of the transistor 34 to one terminal of a capacitor 38 having a suitable value such as approximately twenty seven thousandths of a microfarad (0.027 $\mu$f). The second terminal of the capacitor 38 is common with the negative terminal 16 in the timing circuit 12. The collector of the transistor 34 is also connected to the base of a transistor 40 which may be a PNP transistor. A resistor 42 having a suitable value such as approximately two hundred Kilohms (200 K) is connected between the base and the emitter of the transistor 40. The source of the transistor 40 is common with the movable arm of the switch 26.

A resistor 44 is connected between the collector of the transistor 40 and the negative terminal 16 in the timing circuit 12. The resistor 44 may have a suitable value such as approximately two hundred Kilohms (200 K $\Omega$). A connection is also made from the collector of the transistor 40 to the base of a transistor 46 which may be NPN type. The source of the transistor 46 is common with the negative terminal 16 in the timing circuit 12.

A resistor 48 and a capacitor 50 are in series between the movable arm of the switch 26 and the source of the transistor 46. The resistor 48 may have a suitable value such as approximately three hundred and eighty three ohms (383 $\Omega$). The capacitor 50 may have a suitable value such as approximately sixty eight microfarads (68 $\mu$f). The terminal common to the resistor 48 and the capacitor 50 is connected to the lower stationary contact of the switch 28 in the single FIGURE.

The upper stationary contact of the switch 28 in the single FIGURE is common with the collector of the transistor 46. A connection is made from the movable arm of the switch 28 to an ungrounded terminal of a pyrotechnic device 52. The other contact of the pyrotechnic device 52 is connected to a ground such as a casing in the timing system 10. When fired, the pyrotechnic device 52 may actuate an output unit (not shown) in a manner well known in the art. For example, the output unit may constitute a cutter for a reefing unit or may provide actuation for a thermal battery.

When the movable arms of the switches 26 and 28 engage the upper stationary contacts of the switches as shown in the single FIGURE, the switch 26 provides a short circuit across the capacitor 50 and the resistor 44, and the switch 28 provides a short circuit across the pyrotechnic squib 52. This prevents the capacitor 50 from being charged and the pyrotechnic squib 52 from being fired. At the same time, the voltage on the battery 27 is applied to the positive terminal 14 in the timing circuit 12 to provide power to operate the timing circuit.

When the switch 24 is manually closed, the timing circuit 12 is started for an operational checkout of the timing circuit 12. The movable arms of the ganged switches 26 and 28 become moved from the upper position to the lower position by an operation of the actuating means 30 which may constitute any one of a number of different inputs. When the movable arm of the switch 26 engages the lower stationary contact of the switch, a voltage is applied from the battery 27 through the diode 32 to the start terminal 18 in the timing circuit 12. This initiates the timing of the pre-selected period in the timing circuit 12.

Current also flows from the battery 27 through a circuit including the resistance 48 and the capacitor 50 to charge the capacitor 50. The capacitor 50 becomes charged in a relatively short period of time such as less than one tenth of a second (0.1 sec.). The charging of the capacitor 50 prepares the capacitor 50 to be able to fire the pyrotechnic device. It is desirable for the capacitor 50 to be charged in a relatively short time, particularly when the pre-selected timing period measured by the timing circuit 12 is relatively low.

The timing circuit 12 times the pre-selected period. At the end of the pre-selected period, the timing circuit 12 produces a series of pulses on the line 20. These pulses trigger the transistor 34 into a state of conductivity at the same frequency as the pulses. When the transistor 34 becomes conductive, a relatively low voltage is produced on the collector of the transistor 34. This low voltage discharges the capacitor 38 and is introduced to the base of the transistor 40 to make the transistor 40 conductive. The pulses are filtered out by capacitor 38 as a result of the charging of the capacitor through a circuit including the battery 27, the switch 26 and the base/emitter junction of the transistor 40.

The flow of current through the transistor 40 causes a relatively high voltage to be produced across the resistor 44. This high voltage establishes a state of conductivity in the transistor 46. When the transistor 46 becomes conductive, it has a relatively low impedance. This causes a circuit to be established through the capacitor 50, the switch 28 (in the second state of operation), the pyrotechnic squib 52 and the transistor 46. The capacitor 50 then discharges through the pyrotechnic squib 52 to fire the pyrotechnic squib. The firing of the pyrotechnic squib 52 initiates the operation of an output unit (not shown).

It should be appreciated that the timing and firing system 10 may be disposed on printed circuit boards. One printed circuit board may be formed from the components included within a broken-line rectangle 60 in the single FIGURE. Such components may be considered to relate to delay circuitry. Another printed circuit board may be formed from the components included within a broken-line rectangle 62 in the single FIGURE. Such components may be considered to relate to firing circuitry. The two (2) printed circuit boards may be disposed in a back-to-back relationship in a housing to provide for a compact package within the housing.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

We claim:

1. In combination, first means for providing an electronic timing for a pre-selected period, a pyrotechnic device, switching means having first and second operative relationships, energy storage means, second means operative in the first operative relationship of the switching means for shorting the pyrotechnic device and the energy storage means to prevent the pyrotechnic device from being energized by the energy storage means, third means operative in the second operative relationship of the switching means for storing energy in the energy storage means and for initiating the timing of the pre-selected period by the electronic timing means, and fourth means responsive to the timing of the pre-selected period by the electronic timing means and operative in the second operative relationship of the switching means for energizing the pyrotechnic device.

2. In a combination as set forth in claim 1, the fourth means including additional switching means operative after the timing of the pre-selected period for establishing a closed circuit with the energy storage means and the pyrotechnic device to obtain a discharge of the energy in the storage means through the pyrotechnic squib.

3. In a combination as set forth in claim 1, means for providing an energizing voltage, the third means including means responsive to the operation of the switching means in the second operative relationship and including the energizing voltage means for energizing the electronic timing means to initiate the timing of the pre-selected period.

4. In a combination as set forth in claim 1, the electronic timing means providing a signal upon the timing of the pre-selected period, and means responsive to the signal from the electronic timing means after the timing of the pre-selected period for establishing a low impedance circuit with the energy storage means and the pyrotechnic device to obtain a discharge of the energy in the energy storage means through the pyrotechnic device to trigger the pyrotechnic device.

5. In a combination as set forth in claim 1, the third means including additional switching means having a high impedance before the timing of the pre-selected period by the electronic timing means and responsive to the timing of the pre-selected period by the electronic timing means for providing a low impedance to the discharge of the energy storage means through the pyrotechnic device to fire the pyrotechnic device.

6. In combination, first means for providing an electronic timing for a pre-selected period, means for providing an energizing voltage, switching means having first and second operative relationships, a pyrotechnic device short circuited by the switching means in the first operative relationship of the switching means, energy storage means short circuited by the switching means in the first operative relationship of the switching means and operative to store energy from the energizing voltage means in the second operative relationship of the switching means, the electronic timing means being open circuited from the energizing voltage means in the first operative relationship of the switching means and being connected in a closed circuit with the energizing voltage means in the second operative relationship of the switching means to obtain the timing of the pre-selected period by the electronic timing means, and means responsive to the timing of the pre-selected period by the electronic timing means to obtain a discharge of the energy in the energy storage means through the pyrotechnic device to fire the pyrotechnic device.

7. In a combination as set forth in claim 6, the switching means including first switching means operative in the first relative relationship to short circuit the energy storage means and to prevent the timing of the pre-selected period in the electronic timing means from being initiated and operative in the second relationship to provide for a charging of the energy storage means by the energizing voltage means and to provide for the energizing of the electronic timing means by the energizing voltage means to initiate the timing of the pre-selected period in the electronic timing means.

8. In a combination as set forth in claim 6, the switching means including first switching means operative in the first relationship to short circuit the pyrotechnic device and operative in the second relationship to establish a circuit including the energy storage means and the pyrotechnic device to provide for a discharge of the energy in the energy storage means through the pyrotechnic device.

9. In a combination as set forth in claim 6, a manually operative control switch having first and second relationships and operative in the first relationship to prevent the electronic timing means from being energized by the energizing voltage means even with the switching means in the second operative relationship and operative in the second relationship to provide for an operational checkout of the electronic timing means.

10. In a combination as set forth in claim 8, additional switching means having first and second operative relationships and operative in the first relationship before the timing of the pre-selected period by the electronic timing means to provide a high impedance for preventing the energy storage means from discharging through the pyrotechnic device and responsive to the timing of the pre-selected period by the electronic timing means to become operative in the second relationship and operative in the second relationship to establish a low impedance circuit with the energy storage means and the pyrotechnic device to obtain a discharge of the energy in the energy storage means through the pyrotechnic device to fire the device.

11. In combination, a pyrotechnic device, energy storage means, first means for providing an energizing voltage, electronic timing means, switching means having first and second operating relationships, the switching means being operative in the first relationship to prevent the energy storage means and the pyrotechnic device and the electronic timing means from receiving any energy, and second means including the switching means in the second operative relationship for initially providing a charging of the energy storage means by the energizing voltage and a timing of a pre-selected period by the electronic timing means and for subsequently providing a discharge of the energy in the energy storage means through the pyrotechnic device upon the timing of the pre-selected period by the electronic timing means.

12. In a combination as set forth in claim 11, the switching means being normally operative in the first relationship, and means actuatable to produce a change in the operation of the switching means from the first relationship to the second relationship.

13. In a combination as set forth in claim 11, a manually operable switch having first and second operative relationships and normally operable in the first relationship and connected between the switching means and the electronic timing means to prevent the electronic timing means from timing the pre-selected period and manually actuatable to the second position to provide for an operation of the electronic timing means.

14. In a combination as recited in claim 11, the electronic timing means being operative to provide a signal upon the timing of the pre-selected period, the second means including third means operative in first and second relationships to provide high and low impedances and normally operative in the first relationship to provide the high impedance and responsive to the signal from the electronic timing means to operate in the second relationship to provide the low impedance, the energy storage means, the pyrotechnic device and the third means being connected in a circuit with the switching means in the second operative relationship of the switching means to provide a discharge of the energy in the energy storage means through the pyrotechnic device to fire the pyrotechnic device.

15. In combination, electronic timing means for timing a pre-selected period, a pyrotechnic device, energy storage means, actuatable means, first means associated with the actuatable means before the actuation of the actuatable means for preventing the energy storage means from receiving energy, the pyrotechnic device from being fired and the electronic timing means from timing the pre-selected period, and second means associated with the actuatable means after the actuation of the actuatable means for initially providing a charging of the energy storage means and a timing of the pre-selected period by the electronic timing means and for thereafter providing, after the timing of the pre-selected period by the electronic timing means, a discharge of the energy in the energy storage means through the pyrotechnic device to fire the pyrotechnic device.

16. In a combination as set forth in claim 15 wherein the first means short circuits the pyrotechnic device and the energy storage means before the actuation of the actuatable means and removes the short circuits upon the actuation of the actuatable means and provides an open circuit to the electronic timing means before the actuation of the actuatable means and closes this open circuit upon the actuation of the actuatable means to obtain the timing of the pre-selected period by the electronic timing means.

17. In a combination as set forth in claim 15, the second means including third means for providing a high impedance before the actuation of the actuatable means and for providing a low impedance in a circuit including the energy storage means and the pyrotechnic device after the actuation of the actuatable means to obtain the firing of the pyrotechnic device by the discharge of the energy in the energy storage means.

18. In a combination as set forth in claim 17, the second means including third means for providing a high impedance before the actuation of the actuatable means and for providing a low impedance after the actuation of the actuatable means, the third means being connected in a series circuit with the energy storage means and the pyrotechnic device after the actuation of the actuatable means to obtain a discharge of the energy in the energy storage means through the pyrotechnic device and a firing of the pyrotechnic device.

19. In combination, means for providing an electronic timing for a pre-selected period, a pyrotechnic device, first and second ganged switching means each having first and second operative relationships, energy storage means, first means for providing an energizing voltage, second means for providing a circuit with the first switching means in the first operative relationship of the first switching means to short the pyrotechnic device, third means for providing a circuit with the energy storage means in the first operative relationship of the first switching means to short circuit the energy storage means, fourth means for actuating the first and second switching means into the second operative relationship, fifth means operative in the second operative relationship of the second switching means for charging the energy storage means from the voltage means, sixth means operative in the second operative relationship of the second switching means for activating the electronic timing means to time the pre-selected period, seventh means operative in the second operative relationship of the first switching means for providing for the triggering of the pyrotechnic device by the energy in the energy storage means, and eighth means operative upon the timing of the pre-selected period by the electronic timing means for completing a circuit with the pyrotechnic device and the energy storage means to obtain a firing of the pyrotechnic device by the discharge of the energy in the energy storage means into the pyrotechnic device.

20. In a combination as set forth in claim 19, the eighth means including an electronic switch having closed and open relationships and operative in the open relationship to provide a high impedance and operative in the closed relationship to provide a low impedance, the eighth means being operative in the open relationship before the timing of the pre-selected period by the electronic timing means and being operative in the closed relationship after the timing of the pre-selected period by the electronic timing means, the eighth means being included in a circuit with the pyrotechnic device and the energy storage means in the second operative relationship of the switching means to obtain a firing of the pyrotechnic device.

21. In a combination as set forth in claim 19, the second switching means being operative in the first operative relationship to prevent the timing of the pre-selected period by the electronic timing means.

22. In a combination as set forth in claim 20, the second switching means being operative in the first relationship to prevent the timing of the pre-selected period by the electronic timing means, the first and second switching means being normally operative in the first relationship, and means for operating the first and second switching means from the first operative relationship to the second operative relationship.

* * * * *